US006843600B2

(12) United States Patent
Tilman et al.

(10) Patent No.: US 6,843,600 B2
(45) Date of Patent: Jan. 18, 2005

(54) RESEALABLE CLOSURE ARRANGEMENT WITH PULL STRING ACTIVATED, TAMPER EVIDENT SEAL FOR USE WITH A SLIDER DEVICE

(75) Inventors: Paul A. Tilman, Sherwood, WI (US); James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 75 days.

(21) Appl. No.: 10/341,879

(22) Filed: Jan. 14, 2003

(65) Prior Publication Data

US 2004/0136615 A1 Jul. 15, 2004

(51) Int. Cl.[7] ..... B65D 33/34

(52) U.S. Cl. ..... 383/5; 383/61.2; 383/64; 383/204; 383/206

(58) Field of Search ..... 383/5, 204–209, 383/61.2–61.3, 64

(56) References Cited

U.S. PATENT DOCUMENTS 6,247,843 B1 * 6/2001 Buchman ..... 383/5
6,264,366 B1 * 7/2001 Custer ..... 383/5
6,481,890 B1 * 11/2002 VandenHeuvel ..... 383/64

* cited by examiner

*Primary Examiner*—Jes F. Pascua
(74) *Attorney, Agent, or Firm*—Tracey D. Beiriger

(57) ABSTRACT

A flexible, reclosable package includes first and second panel sections defining an interior, and a zipper sealed to each of the first and second panel sections along a top edge thereof. The zipper includes first and second mating profiles, each having an upper flange. A slider device is constructed and arranged for mounting on the zipper and for interlocking the first mating profile with the second mating profile when the slider device is moved in one direction, and disengaging the first mating profile from the second mating profile when the slider device is moved in another opposite direction. A tamper evident seal attaches the upper flanges of the first and second profiles together and extends through a passageway formed through the slider device. With this construction, pulling of the tamper evident seal will separate the seal from the upper and lower flanges and concurrently engage a portion of the slider device to progressively move the slider device across the first and second closure profiles to provide access to the interior of the package.

17 Claims, 8 Drawing Sheets

RESEALABLE CLOSURE ARRANGEMENT WITH PULL STRING ACTIVATED, TAMPER EVIDENT SEAL FOR USE WITH A SLIDER DEVICE

FIELD OF THE DISCLOSURE

The present disclosure generally relates to closure arrangements for packages. In particular, the present disclosure relates to closure arrangements having reclosable profiles and slider devices to open and close the profiles.

BACKGROUND OF THE DISCLOSURE

Many packaging applications use resealable containers to store various types of articles and materials. These packages may be used to store and ship food products, non-food consumer goods, medical supplies, waste materials, and many other articles. Slider devices have been used to help open and close closure profiles on reclosable and/or resealable bags and other packages.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some perishable goods are sold to consumers packaged in reclosable bags or other packages. For example, cheese, meat or vegetable products can be packaged in a bag with reclosable closure profiles so that after opening the package, the package can be reclosed and the freshness of the product retained. Often these packages include tamper evident features to inform the consumer whether the package previously has been opened. Because of the construction of these packages with reclosable closure profiles, it has been difficult to place a tamper evident feature on a bag or package that uses a slider device to help open and close the reclosable closure profiles.

Improvements in packaging, that include tamper evident features and easily resealable seals, are desirable.

SUMMARY OF THE DISCLOSURE

The present disclosure relates to a package, such as a flexible package, having a combination of a resealable, reclosable zipper comprising first and second engagable closure profiles and a tamper evident seal. The tamper evident seal extends along the width of the package. Opening and closing of the zipper is accomplished by a slider device mounted on the zipper. The slider device facilitates mating and unmating of the first and second closure profile numbers of the zipper. The slider device includes a top wall and a support structure that retains or otherwise receives the tamper evident seal, to provide access to the interior of the package. An attempt to gain access to the interior of the package requires moving the slider device across the zipper by concurrently removing the tamper evident seal.

In particular, this disclosure relates to a package comprising a package enclosure having at least two side edges and a mouth running across a top edge of the package, the mouth providing access to the package interior. The reclosable zipper having first and second closure profiles along the mouth selectively opens and closes the mouth. Typically, the first and second closure profiles include engagable first and second closure members. The tamper evident seal takes the form of a pull string which extends below the top edge of the package and beneath the top wall of the slider device, in addition to being constructed and arranged to selectively open and close the mouth to provide access to the package interior, the slider device has a passageway constructed and arranged to hold and guide the pull string. Removably pulling the string to break the tamper evident seal will simultaneously cause the pull string to engage the slider device and progressively move the slider device to open the zipper and the package.

DETAILED DESCRIPTION OF PREFERRED EMBODIMENTS

Figure 1:
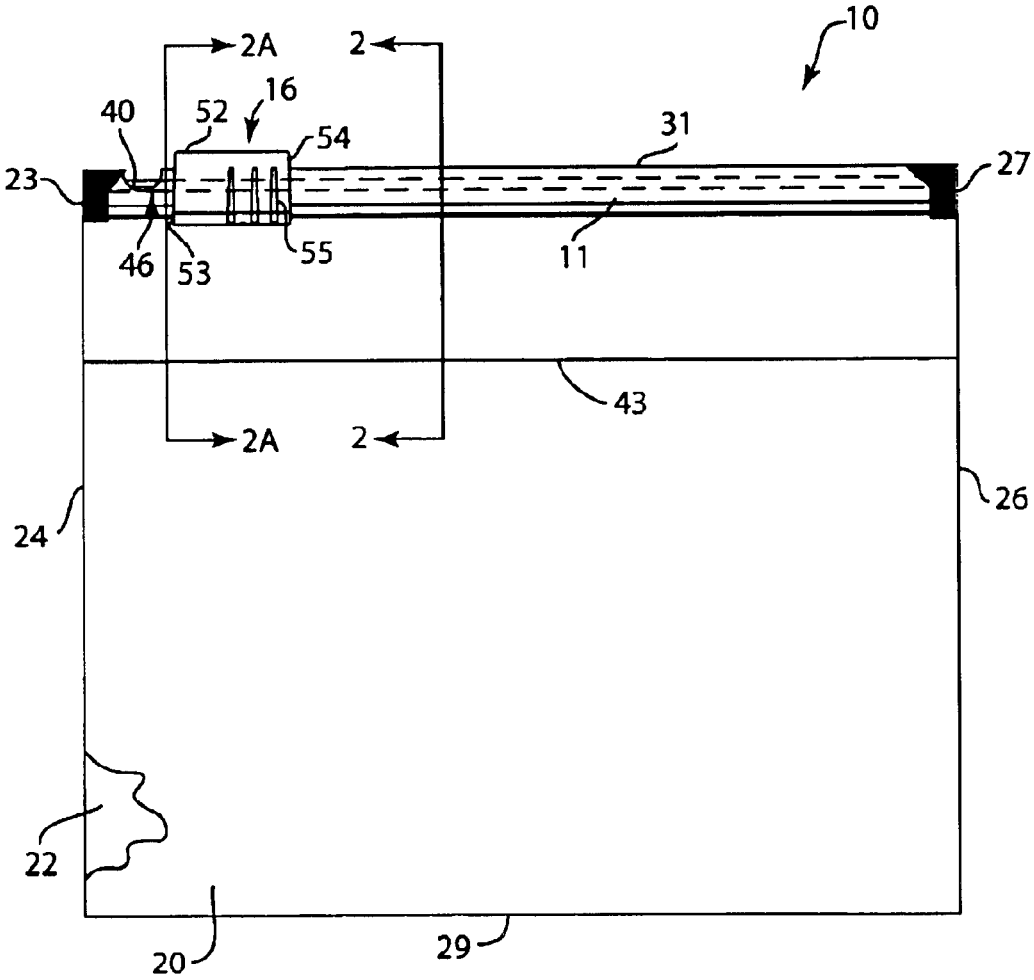
FIG. 1 is a side elevational view of a preferred embodiment of a flexible resealable package having a pull string activated, tamper evident seal used with a slider device according to the principles of the invention.
Figure 2:
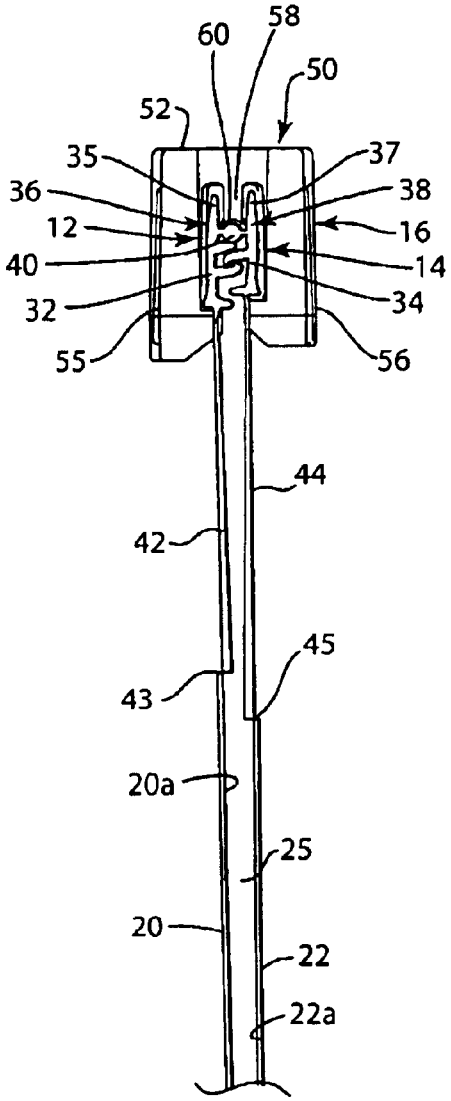
FIG. 2 is an end view in partial section taken on FIG. 2—2 of FIG. 1.
Figure 2A:
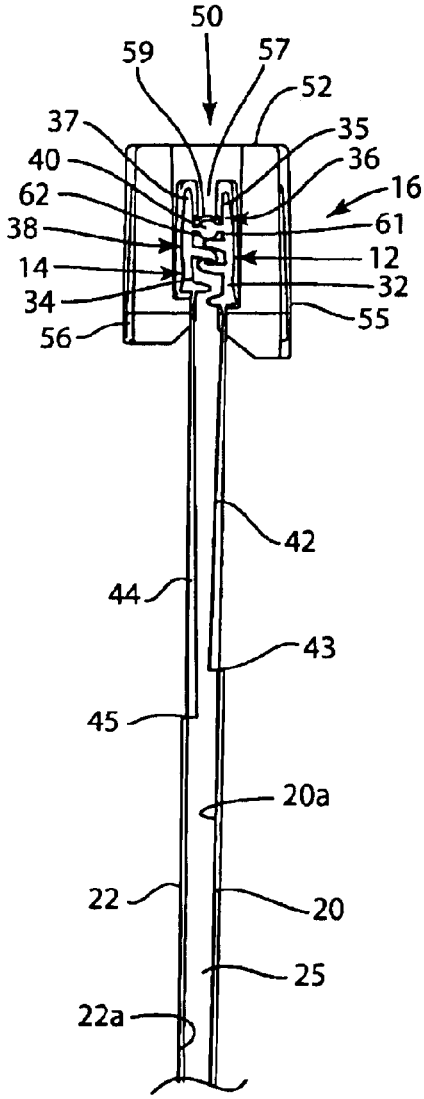
FIG. 2A is an end view in partial section taken on FIG. 2A—2A of FIG. 1.

Attention is directed to FIGS. 1 through 5A which illustrate an example of a packaging arrangement in the form of a resealable, flexible package 10 having a zipper 11 with first and second closure profiles 12, 14 and a slider device 16 to engage and disengage the profiles 12, 14. In FIGS. 2 and 2A, first and second closure profiles 12, 14 are mated, that is, engaged.

The flexible package 10 includes first and second opposed panel sections 20, 22 made from a flexible, polymeric film. For some manufacturing applications, the first and second panel sections 20, 22 are heat-sealed together along two side edges 24, 26 (FIG. 1) and meet at a bottom edge 29 in order to form a three-edged containment section for a product within the interior 25 (FIGS. 2, 2A), of the package 10. Access is provided to the interior 25 of the package through a mouth (FIG. 5) at open top edges 31 of the package 10; in the embodiment shown, the mouth 30 extends across the width of the package 10.

The zipper 11 can include a variety of configurations and structures. In the particular reclosable zipper arrangement shown in FIGS. 2 and 2A, the zipper 11 has mating first and second closure profiles 12, 14 in the form of a first profile member 32 and a second profile member 34. The first profile member 32 has a first upper flange 35 rising from a first profile element 36, and the second profile member 34 has a second upper flange 37 rising from a second profile element 38. Inside surfaces of the upper flanges 35, 37 are joined together by a tamper evident seal 40 to be described hereafter. The first profile member 32 has a first lower flange 42 depending from the first profile member element 36, and the second profile member 34 has a second lower flange 44 depending from the second profile member element 38. If the zipper 11 is formed separately from the panel sections 20, 22, the first and second lower flanges 42, 44 are attached, typically thermally fused at 43, 45, as illustrated in FIGS. 2, 2A, to inner surfaces 20*a*, 22*a* of the respective first and second panel sections 20, 22. Alternatively, the zipper 11 may be extruded with the panel sections 20, 22 so that the first lower flange 42 is integrally formed with the first panel section 20, and the second lower flange 44 is integrally formed with the second panel section 22.

Referring again to FIGS. 1, 2 and 2A, slider device 16, mounted on zipper 11, opens and closes (unmates and mates) first and second closure profiles 12, 14. When slid in a first direction, slider device 16 opens profiles 12, 14 by providing a wedge between the two profiles 12, 14. First and second profiles 12, 14 can then be spread apart to provide access to the package interior 25 (FIGS. 2, 2A) through package mouth 30. When slid in an opposite, second direction, slider device closes profiles 12, 14 by pressing the two profiles 12, 14, in particular, first profile member 32 and second profile member 34 (illustrated in FIGS. 2 and 2A) together so that they engage and mesh, providing a seal. Slider devices and how they function to open and close zipper closures, in general, are taught, for example, in U.S. Pat. Nos. 5,063,644; 5,301,394; 5,442,837; 5,664,229; and 6,293,701, each of which is incorporated by reference herein.

Two portions of zipper 11, one close to first side edge 24 and another close to second side edge 26, act as slider stop regions. These slider stop regions are crushed, such as by ultrasonic crushing, and are shown as crushed areas 23, 27 in FIG. 1. These crushed areas 23, 27 securely seal first and second mating profiles 12, 14 together to minimize the chance of slider device 16 sliding off edges 24, 26 of package 10. The crushed areas 23, 27 further minimize the tendency for slider device 16 to directly abut either of the side edges 24, 26.

A cutout 46 is preferably formed in the upper flanges, 35, 37 of the zipper 11 and disposed near the side edge 24 of the package 10. The cutout 46 has a curved edge 48 (FIG. 3), serves as a "parking place" for the slider device 16 and also facilitates mounting the slider device 16 onto the resealable package 10 during initial assembly. As will be further appreciated below, the cutout 46 additionally defines a finger hole for accessing the removable tamper evident seal 40 to be detailed below.

The slider device 16 includes a housing 50 for slidably engaging the zipper 11. The housing 50 is movable between a closed position of the resealable package 10 when the slider device 16 is adjacent the side edge 24, and an open position when the slider device 16 is moved adjacent the side edge 26. FIG. 1, with the slider device 16 moves to the right of cutout 46, illustrates the zipper 11 of the resealable package 10 in a partially open position. The housing 50 slides over the zipper 11 relative to the top edge 31 of the resealable package 10 to open and close the mouth 30.

Figure 3:
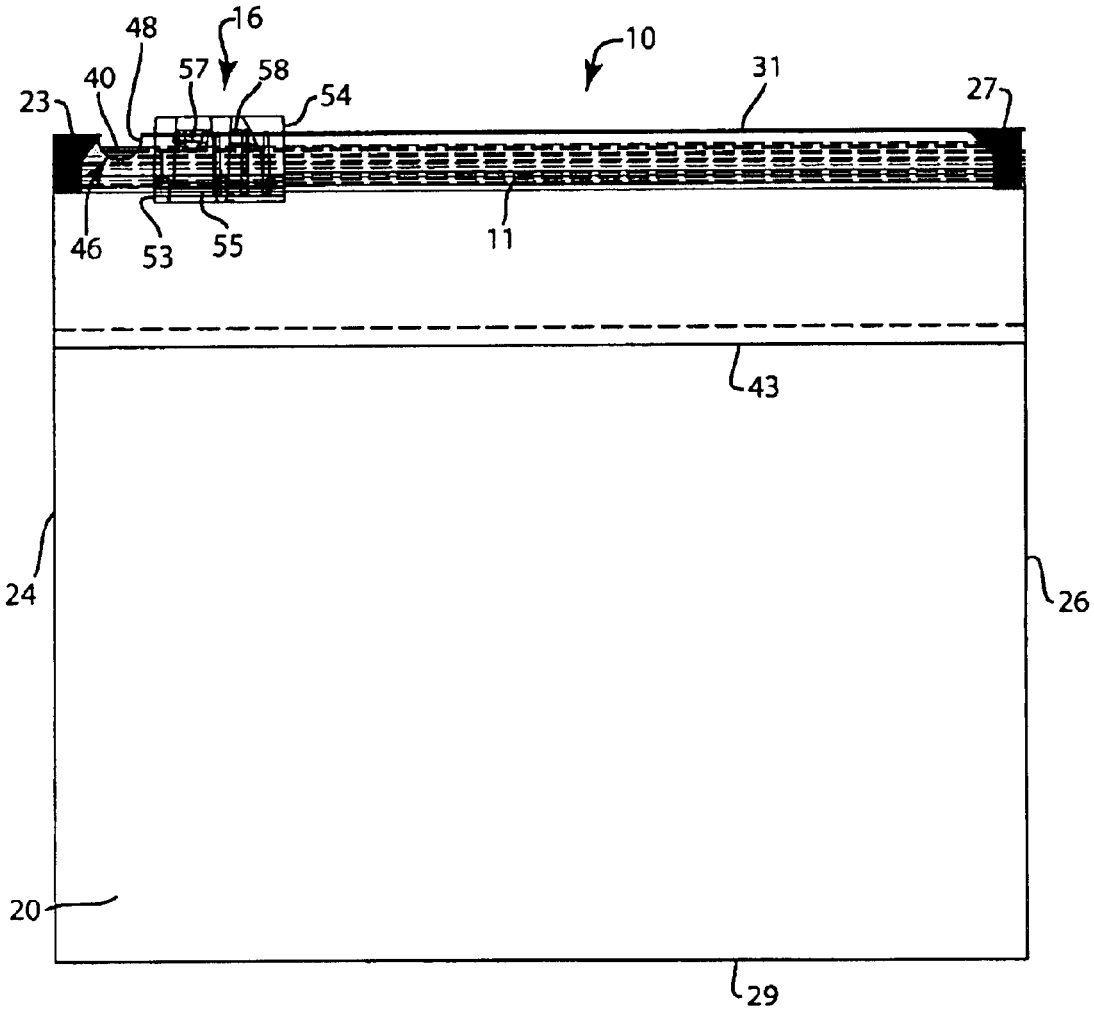
FIG. 3 is a view similar to FIG. 1 showing a longitudinal section of the slider device.
Figure 4:
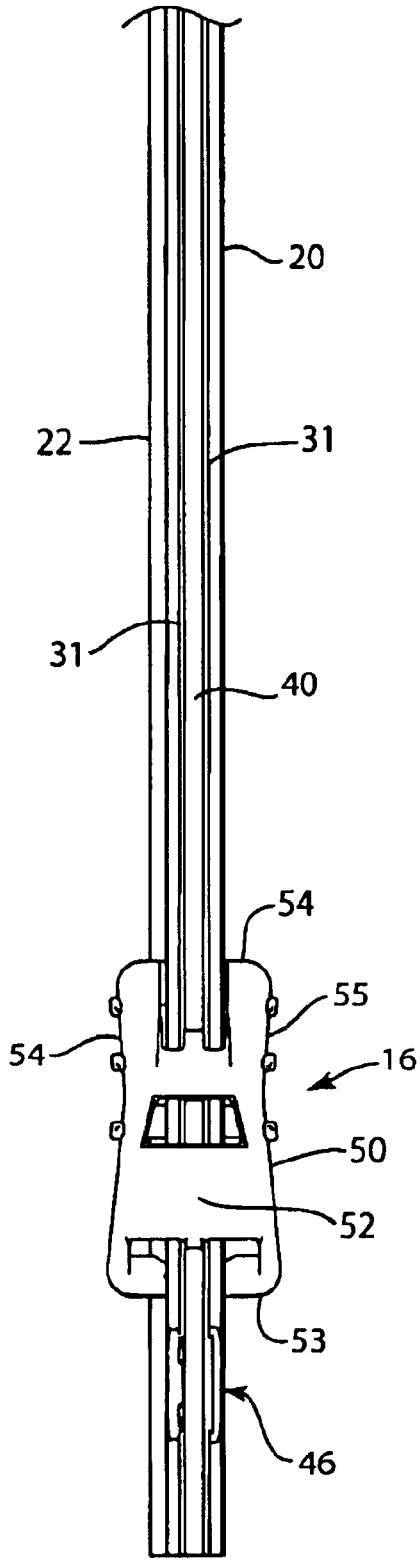
FIG. 4 is a plan view of FIG. 3.

In the embodiment of FIGS. 1 through 5A, the housing 50 includes a top wall 52 having a first end 53 and an opposite second end 54. The housing 50 also includes first and second side walls 55, 56 integrally depending from the top wall 52 so as to form a channel for receiving the zipper 11. The housing 50 further includes a system for guiding the slider device 16 between the side edges 24, 26 (FIG. 1) and for preventing the slider device 16 from sliding off the edges 24, 26 of the package 10. The system includes a guide structure (not shown) associated with the slider device 16 for engaging crushed areas 23, 27. The housing 50 additionally includes a support structure which depends from the top wall 52 but could extend from other portions of the housing 50. As seen in FIGS. 2, 2A and 3, the support structure preferably comprises a first support element 57, and a second support element 58 spaced from the first support element 57. The first support element 57 has a lower end which is notched at 59 and the second support element 58 likewise has a lower end which is preferably notched at 60. The notches 59, 60 are axially aligned to define a retaining passageway through the slider device 16 and beneath top wall 52 for receiving and guiding the tamper evident seal 40 for a purpose to be explained below. In the preferred embodiment, the notches 59, 60 have a substantially concave or otherwise curved shape, but it should be understood that the notches 59, 60 could have other shapes which cooperate with the particular peripheral shape of the tamper evident seal 40 to retain and guide the seal 40 through the slider device 16.

The tamper evident seal 40 is provided to evidence whether or not the reclosable package 10 has been previously opened. By "tamper evident", it is meant that an attempt to breach the integrity of a seal is evidenced or shown by damage to distortion or destruction of the seal. The tamper evident seal 40 is sealed on upper flanges 35, 37 of first and second closure profiles 12, 14 and extends below the top edges 31 of the resealable bag 10. It will be appreciated that when tamper evident seal 40 is undisturbed (that is, seal 40 has not been penetrated, breached or otherwise disturbed), first and second closure profiles 12, 14 cannot be spread in order to provide access to the package interior 25.

Figure 6:
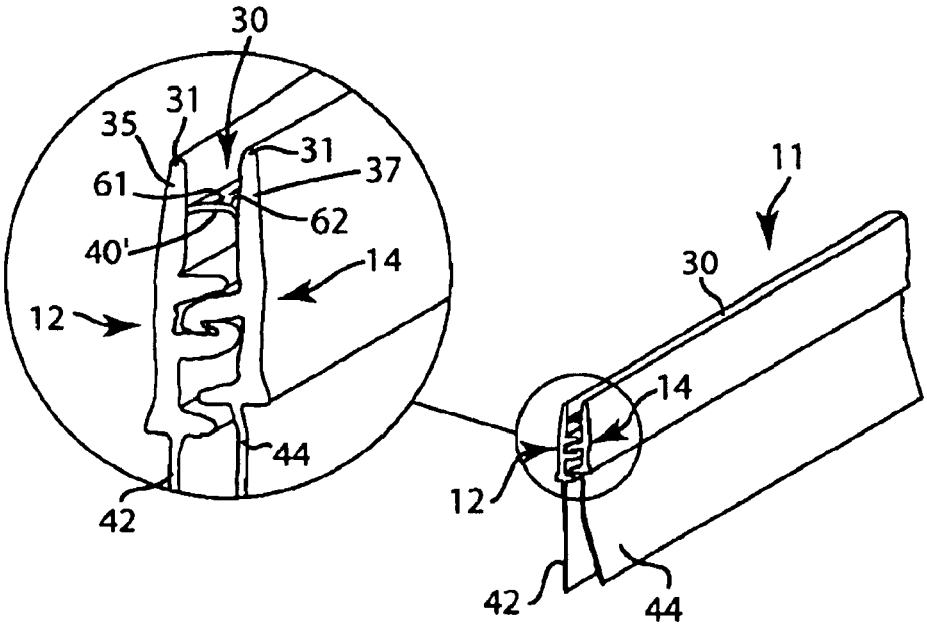
FIG. 6 is a fragmentary, sectional view in perspective of a pull string activated, tamper evident seal in the form of a tear strip positioned between a pair of perforation lines.
Figure 7:
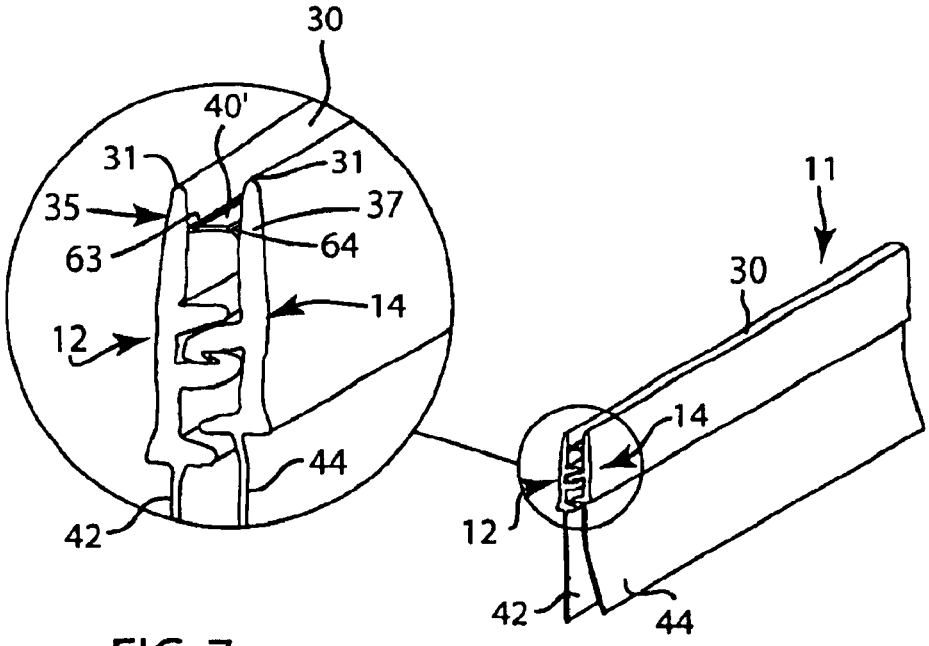
FIG. 7 is a view like FIG. 6 showing the tamper evident seal in the form of a flat tear strip positioned between a pair of score lines.
Figure 8:
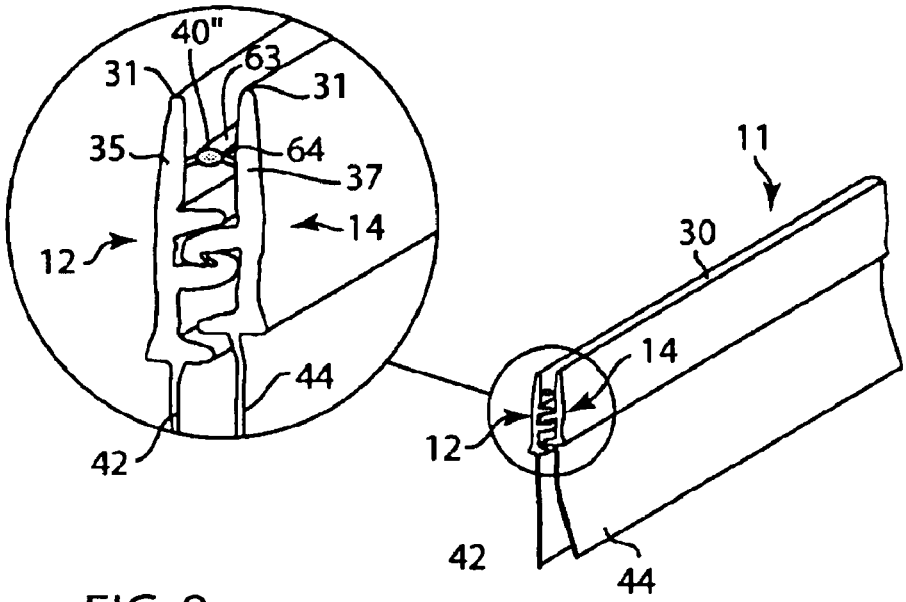
FIG. 8 is a view like FIG. 6 showing the tamper evident seal in the form of an oval bead positioned between a pair of score lines.
Figure 9:
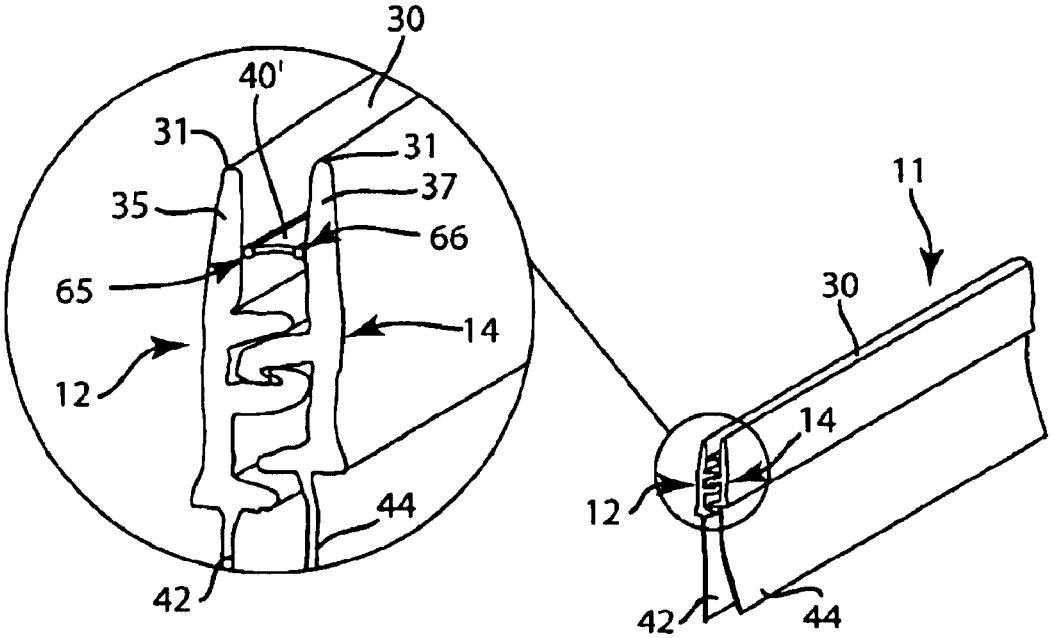
FIG. 9 is a view like FIG. 6 showing the tamper evident seal in the form of a tear defined between a pair of parallel, circular beads.

More specifically, tamper evident seal 40 takes the form of a removable pull string which connects inside surfaces of the upper flanges 35, 37 together beneath the top wall 52 of the slider device 16. The pull string 40 continuously extends beneath the mouth 30 of the package 10 and passes through the slider device 16 in complimentary engagement with the notches 59, 60 formed therein. In order to access the interior 25, slider device 16 must be moved along zipper 11 which can only be done if the pull string 40 has been penetrated; typically, the pull string 40 has to be removed. The package 10 includes an area of weakness which allows for easy removal of the pull string 40. In some package embodiments, the area of weakness is at least one perforation line, laser score, tear strip, zip strip, or other weakened area that allows for easy removal of the pull string 40. For example, FIG. 6 shows an alternative pull string 40 in the form of a flat tear strip 40' positioned between a pair of perforation lines 61, 62. FIG. 7 shows another alternative flat tear strip 40' positioned between a pair of parallel score lines 63, 64. FIG. 8 shows a further tear bead 40" having an oval cross section and positioned between parallel score lines 63, 64. FIG. 9 shows an additional flat tear strip 40' positioned between a pair of parallel circular beads 65, 66. In the preferred embodiment, the pull string 40 takes the form of a tear bead having a generally circular cross section as seen best in FIGS. 2 and 2A. At the junction between the opposed sides of the pull string or tear bead 40 and inside surfaces of the upper flanges 35, 37, a pair of parallel perforation lines 61, 62 (such as shown in FIGS. 2A and 6) are formed along the width of the package 10 to facilitate separation of the tear bead 40 from the package 10.

Although tamper evident seal 40 extends from first side edge 24 to second side edge 26 along the length of the zipper 11, the seal 40 does not encase the length of zipper 11 nor does seal 40 encase the slider device 16. Rather, slider device 16 remains accessible, preferably parked in cutout 46 in zipper 11.

As a distinctive feature of the invention, because of its engagement with slider device 16, the pull string or tear bead 40 is advantageously used to move the slider device 16 across the width of zipper 11 to progressively open the package 10 simultaneously as the tear bead 40 is pulled away and separated from zipper 11.

Figure 5:
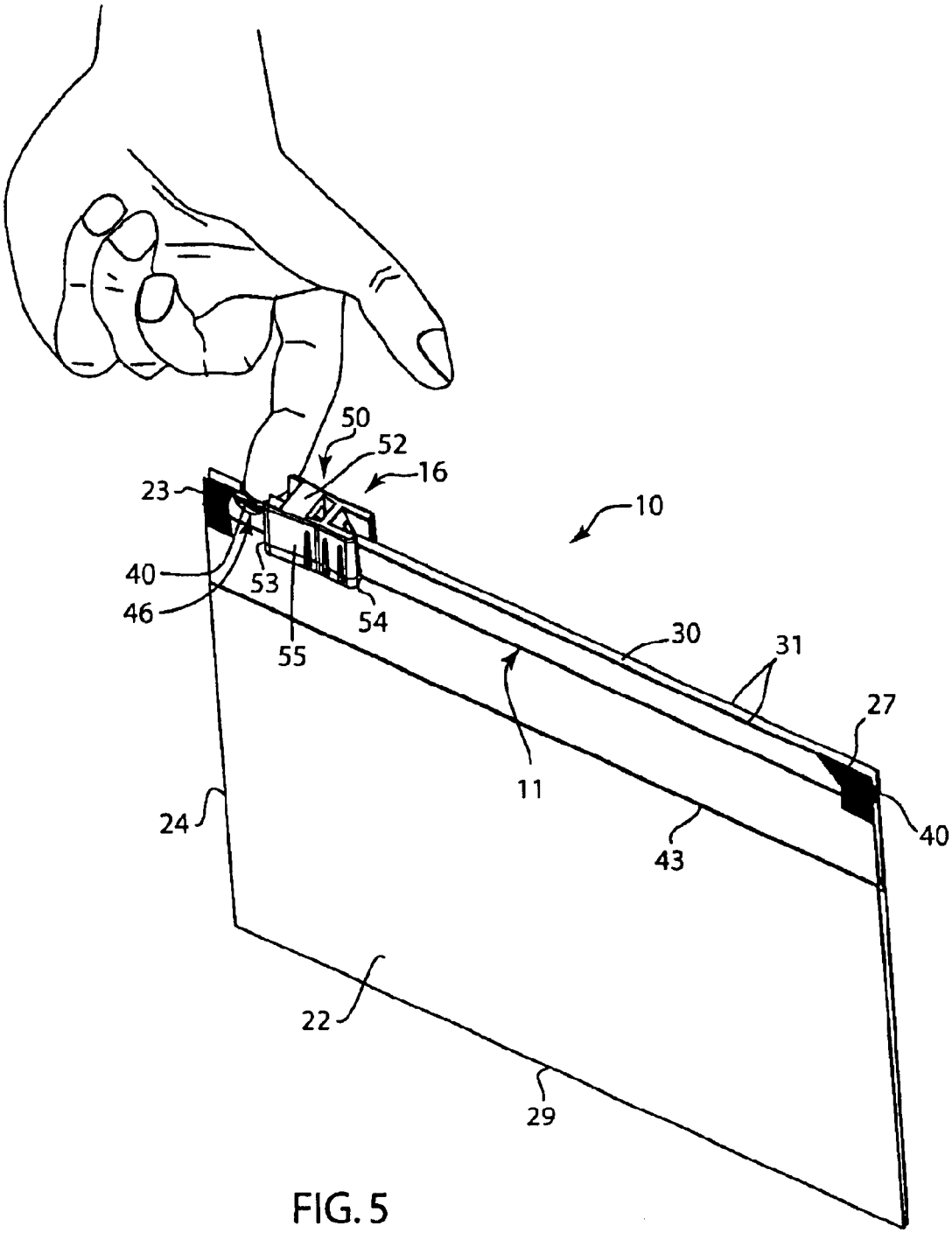
FIG. 5 is a perspective view of the package of FIG. 1 showing the accessing of the pull string activated, tamper evident seal with one's fingers.
Figure 5A:
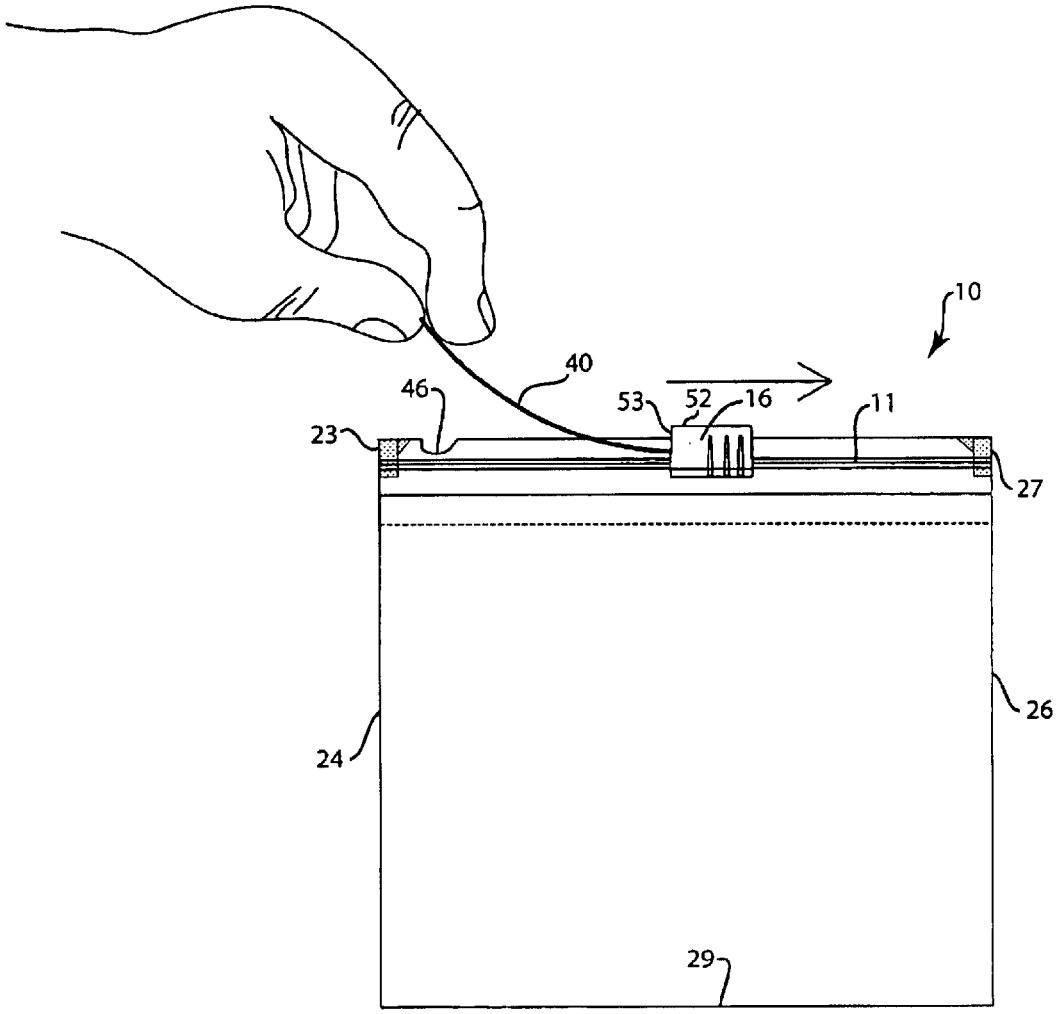
FIG. 5A is a view like FIG. 1 showing the manner in which the pull string is separated from the package and used simultaneously to move the slider device across a zipper.

In use, the resealable bag 10 in FIG. 1 will be in a closed position with the slider device 16 positioned over cutout 46, and slider device 16 abutting the crushed area 23 adjacent side edge 24. Pull string 40 is sealed completely across package 10 below the top edge 31 thereof and beneath the top wall 52 of slider device 16, and holds upper flanges 35, 37 of zipper 11 together. Moving the slider device 16 immediately past the cutout 46 as shown in FIG. 1, will partially open the zipper 11. During this initial movement, the top wall 52 of slider device slides over the pull string 40 which remains sealed to prevent access of the interior 25 of the bag 10. A bag user then employs cutout 46 as a finger hole (FIG. 5) to grasp pull string 40 with his/her fingers and pull upwardly on the end of pull string 40 nearest side edge 24. As shown in FIG. 5A, this pulling motion commences separation of the pull string 40 from the inside surfaces of the upper flanges 35, 37 of the zipper 11 such that pull string 40 will engage the first end 53 of the top wall 52 of slider device 16, and simultaneously force the slider device 16 to progressively move across the package 10 to further open the zipper 11. Once slider device 16 abuts the crushed area 27 near side edge 26, the pull string 40 can be removed and discarded and the bag 10 will be in a fully open position so as to access the interior 25 of bag 10. When it is desired to close the bag 10, the slider device 16 is simply moved directly by hand in the opposite direction towards crushed area 23 so as to reclose the bag 10.

Although not illustrated, an alternative slider device 16 may be used with the resealable bag 10 and pull string 40 described above. In one such design, the slider device 16 has a top wall 52 having a rear opening, side walls 55, 56 and a door pivotally mounted on a rear end of side wall 56. The door is pivoted between an open position and a closed position. The door carries a projecting pin which is received in a snap fit within a suitable pin opening formed in the rear end of side wall 55. The pivotal mounting of the door creates a small gap for guiding and loosely trapping pull string 40 which extends into an opening at the top of slider device 16. The slider device 16 operates in the same basic manner for the same purpose as described above. That is, pulling on string 40 will cause concurrent removal of string 40 and force the slider device 16 to move along the zipper 11 so as to quickly and conveniently open the bag 10.

It should now be understood that engaging the tamper evident seal or pull string 40 against the slider device 16 enables removal of the pull string 40 and provides substantially simultaneous movement of the slider device 16 to the open position of the package 10 in one concise step.

The above specification and examples are believed to provide a complete description of the manufacturing use of particular embodiments of the disclosure. Many embodiments of the disclosure can be made without departing from the spirit and scope of the disclosure. Having described the presently preferred embodiments, it is to be understood that the invention may be otherwise embodied within the scope of the appended claims.

What is claimed is:

1. A flexible, reclosable package comprising:

(a) first and second panel sections defining an interior;

(b) a zipper sealed to each of the first and second panel sections along a top edge thereof, the zipper extending from a first side edge to a second side edge and comprising first and second mating profiles, each having an upper flange;

(c) a slider device constructed and arranged for mounting on the zipper and for interlocking the first mating profile with the second mating profile when the slider device is moved in one direction and disengaging the first mating profile from the second mating profile when the slider device is moved in another opposite direction, the slider device being operably mounted on the zipper; and (d) a first tamper evident seal attaching the upper flanges of the first and second profiles together and extending through a passageway formed through the slider device such that pulling of the tamper evident seal will separate the seal from the upper and lower flanges and concurrently engage a portion of the slider device to progressively move the slider device across the first and second closure profiles from the first side edge to the second side edge to provide access to the interior of the package.

2. A package comprising:

(a) a package surrounding wall having first and second side edges and a mouth therebetween, the mouth having a length and providing access to a package interior;

(b) a reclosable zipper along the mouth for selective opening and closing of the mouth, the zipper including first and second closure profiles, (i) the first closure profile comprising a first closure member element having a first lower flange and a first upper flange opposite the first lower flange;

(ii) the second closure profile comprising a second closure member element having a second lower flange and a second upper flange opposite the second lower flange;

(iii) the first and second closure members being configured and constructed to selectively interlock;

(iv) the first and second lower flanges being secured to the package surrounding wall;

(c) a slider device mounted upon the zipper for selectively opening and closing the zipper, the slider device including (i) a top wall sidably mounted for movement over the first and second upper flanges;

(ii) first and second side walls depending from and integral with the top wall, and (iii) a support structure having a retaining passageway located beneath the top wall; and (d) a tamper evident seal attaching the first upper flange to the second upper flange;

(i) the tamper evident seal being in the form of a removable pull string extending across the package and through the passageway formed in the slider device, whereby removably pulling the string from the first side edge of the package to the second side edge of the package to separate the string therefrom will engage the slider device and, at the same time, progressively move the slider device across the first and second closure profiles to open the zipper and provide access to the package interior.

3. The package of claim 2, wherein the first and second upper flanges of the zipper are provided with a finger hole positioned adjacent the first edge of the package for accessing the pull string.

4. The package of claim 2, wherein the first and second upper flanges of the zipper have inner surfaces to which opposite sides of the pull string are attached.

5. The package of claim 2, wherein the support structure of the slider device includes a pair of spaced apart, support elements depending from the top wall, each of the support elements having lower ends formed with notches for engaging and guiding the pull string.

6. The package of claim 2, wherein the pull string is attached to the first and second upper flanges along a pair of perforation or score lines.

7. The package of claim 2, wherein the pull string takes the form of an elongated bead of circular cross section.

8. The package of claim 2, wherein the pull string takes the form of an elongated bead of oval cross section.

9. The package of claim 2, wherein the pull string takes the form of a flat tear strip.

10. The package of claim 9, wherein the tear strip has a pair of opposed side edges in the form of perforation lines.

11. The package of claim 9, wherein the tear strip has a pair of opposed side edges in the form of score lines.

12. The package of claim 9, wherein the tear strip has a pair of opposed side edges in the form of tear beads.

13. A method of using a flexible package, the flexible package comprising a package body defining an interior, a zipper comprising first and second mating profiles extending along a top edge of the package body, the zipper providing access to the interior, a slider device operably mounted on the zipper, the slider device disengaging the first closure profile from the second closure profile when the slider device is moved in a first direction, and interlocking the first closure profile with the second closure profile when the slider device is moved in a second opposite direction, and a tamper evident structure including an elongated pull element sealing the first and second closure profiles together below the top edge of the package and beneath a top wall of the slider device such that the tamper evident structure will engage the slider device, the method comprising:

(a) removing the tamper evident structure engagable with the slider device from the flexible package; and (b) simultaneously moving the slider device in the first direction to disengage the first and second mating profiles, thereby providing access to the package interior.

14. The method according to claim 13, wherein the step of removing the tamper evident structure from the flexible package comprises:

(a) removing the tamper evident structure at an area of weakness.

15. The method according to claim 14, wherein the step of removing the tamper evident structure at an area of weakness comprises:

(a) removing the tamper evident structure from a pair of perforation or score lines.

16. The method according to claim 13, wherein the step of removing the tamper evident structure from the flexible package comprises:

(a) removing the tamper evident structure from the flexible package at upper edges of the zipper.

17. A method of making a package comprising a package body defining an interior;

a zipper comprising a first mating profile and a second mating profile extending along a first edge of the package body, the zipper providing access to the interior;

a slider device operably mounted on the zipper, the slider device disengaging the first mating profile from the second mating profile when the slider device is moved in a first direction and interlocking the first mating profile with the second mating profile when the slider device is moved in a second opposite direction, and a tamper evident structure extending axially through the slider device, the method comprising:

(a) providing the package body having an interior surface and defining the package interior;

(b) attaching the zipper to the interior surface of the package body;

(c) mounting the slider device onto the zipper; and (d) forming the tamper evident structure as a pull string engagable with the slider device by (i) sealing the package body along the upper edges of the zipper and beneath a top wall of the slider device such that pulling the pull string will remove the pull string from the package and concurrently move the slider device in the first direction to open the package and provide access to the interior of the package.

* * * * *